US008939301B1

(12) United States Patent
Small

(10) Patent No.: US 8,939,301 B1
(45) **Date of Patent: *Jan. 27, 2015**

(54) COMBINATION LOCKING STORAGE CONTAINER

(71) Applicant: Steven Douglas Small, Novato, CA (US)

(72) Inventor: Steven Douglas Small, Novato, CA (US)

(73) Assignee: Steven Douglas Small, Novato, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/148,660

(22) Filed: Jan. 6, 2014

Related U.S. Application Data

(60) Provisional application No. 61/758,741, filed on Jan. 30, 2013.

(51) Int. Cl.

| | |
|---|---|
| ***A61J 1/00*** | (2006.01) |
| ***B65D 55/02*** | (2006.01) |
| ***E05B 37/02*** | (2006.01) |
| ***B65D 55/14*** | (2006.01) |

(52) U.S. Cl.
CPC ..... *B65D 55/14* (2013.01)
USPC ..... 215/206; 70/58; 70/166; 215/208; 215/230; 220/8

(58) Field of Classification Search
CPC . E05B 73/00; E05B 73/0005; E05B 73/0017; E05B 73/0023; E05B 73/0041; B65D 50/061; B65D 55/02; B65D 55/026; B65D 55/14
USPC ..... 70/58, 63, 163, 166; 215/230; 220/8, 220/686, 737, 739
See application file for complete search history.

(56) References Cited

U.S. PATENT DOCUMENTS

| | | | | |
|---|---|---|---|---|
| 3,988,909 | A | 11/1976 | Catapano | |
| 4,227,388 | A | 10/1980 | Nigrelli | |
| 4,573,332 | A | 3/1986 | Ma | |
| 4,690,292 | A | 9/1987 | Henning | |
| 4,869,082 | A | 9/1989 | Appelbaum | |
| 4,991,729 | A | 2/1991 | Hunter | |
| 5,172,575 | A | 12/1992 | Fisher | |
| 5,277,325 | A | 1/1994 | Yan | |
| 5,284,262 | A | 2/1994 | O'Nan | |
| 5,427,266 | A * | 6/1995 | Yun | 220/377 |
| 5,833,087 | A * | 11/1998 | Pfeiffer | 215/230 |
| 6,059,132 | A | 5/2000 | Benjamin | |
| 7,107,803 | B1 | 9/2006 | Swanson | |
| 7,252,204 | B1 | 8/2007 | Small | |
| 7,600,648 | B2 | 10/2009 | Hammer | |
| 7,681,422 | B2 | 3/2010 | Tonaltzin | |
| 7,866,505 | B2 | 1/2011 | Perlman et al. | |

(Continued)

OTHER PUBLICATIONS www.thelockingcap.com.

(Continued)

*Primary Examiner* — Christopher Boswell

(57) ABSTRACT

This invention pertains to a combination locking storage container consisting of a tray and a detachable combination locking cover assembly used to secure the contents held within. The tray has an integrally formed key post at its uppermost position. The tumblers of the cover assembly engage the key post and lock to it. When the indicia of the tumblers and correct unlocking code are in alignment with a marker, the cover assembly may be installed or removed.

6 Claims, 11 Drawing Sheets

(56) References Cited

U.S. PATENT DOCUMENTS

| | | | | |
|---|---|---|---|---|
| 8,020,415 | B2 | 9/2011 | Corbin et al. | |
| 8,201,705 | B2 | 6/2012 | Williamson | |
| 8,237,541 | B2 * | 8/2012 | Wang | 70/63 |
| 8,517,193 | B1 | 8/2013 | Small | |
| 8,662,330 | B2 * | 3/2014 | Simpson | 70/158 |
| 2006/0207958 | A1 * | 9/2006 | Hamer | 70/77 |
| 2009/0120898 | A1 * | 5/2009 | Hunt et al. | 215/230 |
| 2011/0174758 | A1 * | 7/2011 | Gonzalez Sanchez et al. | 215/206 |
| 2011/0210136 | A1 * | 9/2011 | Wang | 70/63 |
| 2013/0062303 | A1 * | 3/2013 | Serell | 215/206 |
| 2014/0008319 | A1 * | 1/2014 | Buxton-Dakides | 215/230 |
| 2014/0202978 | A1 * | 7/2014 | Hwang | 215/230 |

OTHER PUBLICATIONS www.lockmed.com.
www.flambeau-scriptsafe.com.
www.rxdrugsafe.com.

* cited by examiner

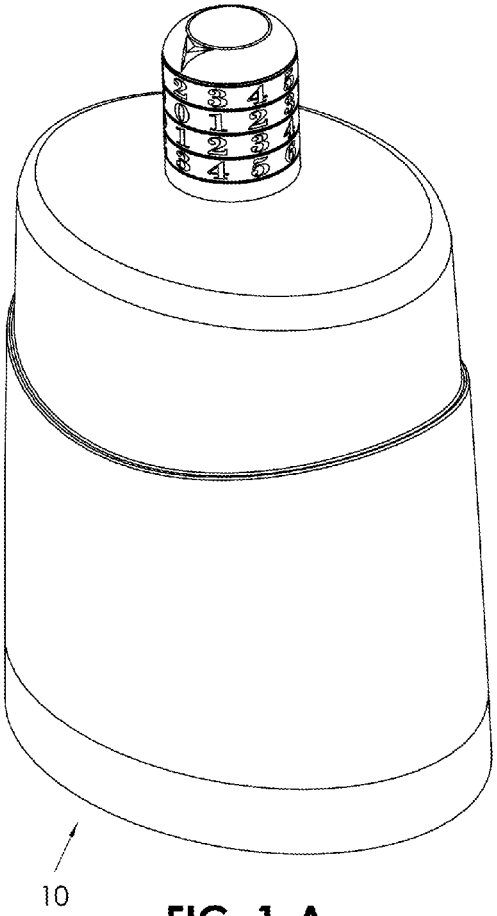
FIG. 1-A
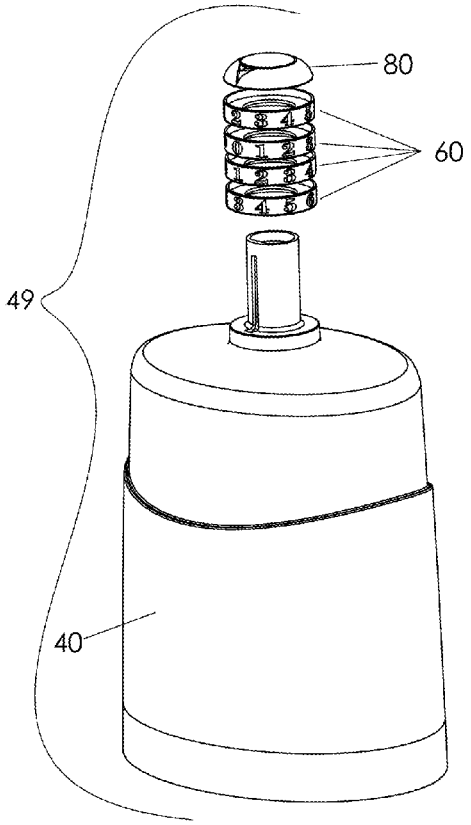
FIG. 1-B
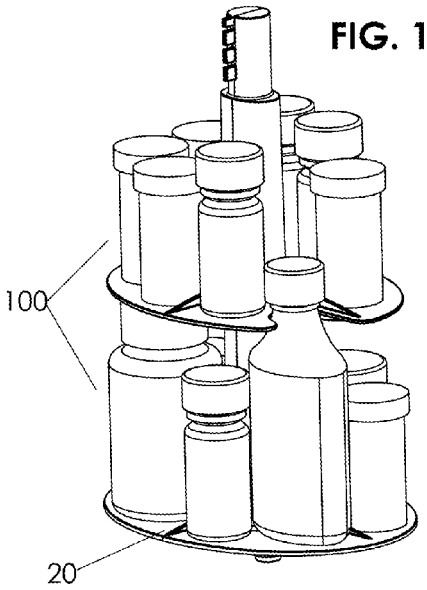

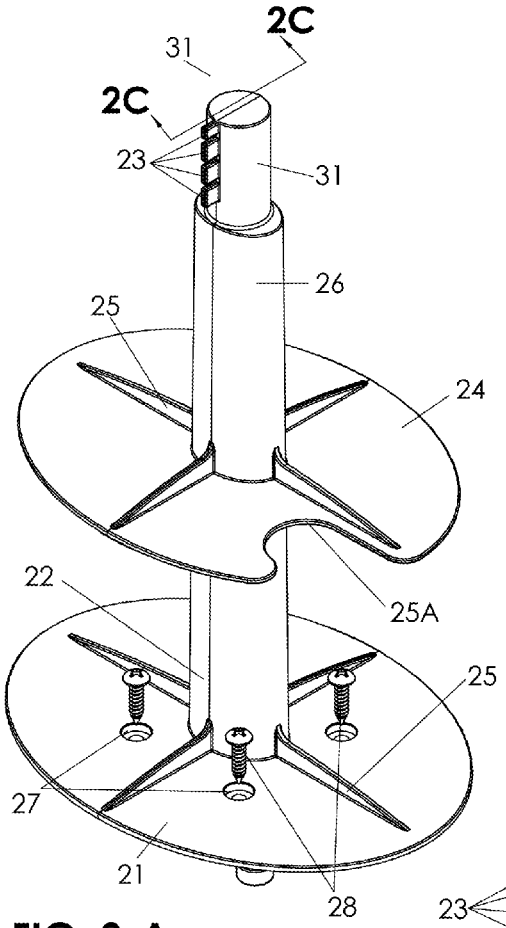
FIG. 2-A
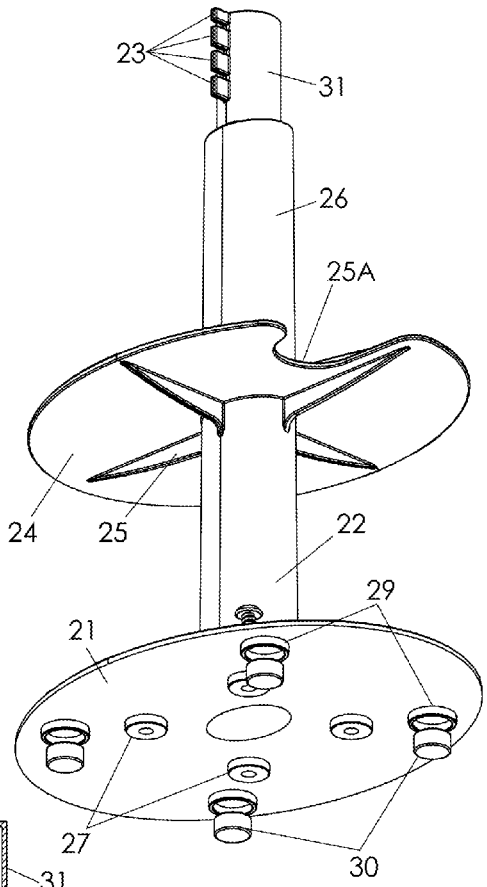
FIG. 2-B
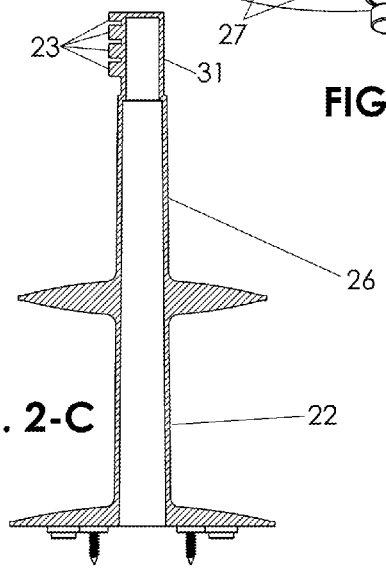
FIG. 2-C

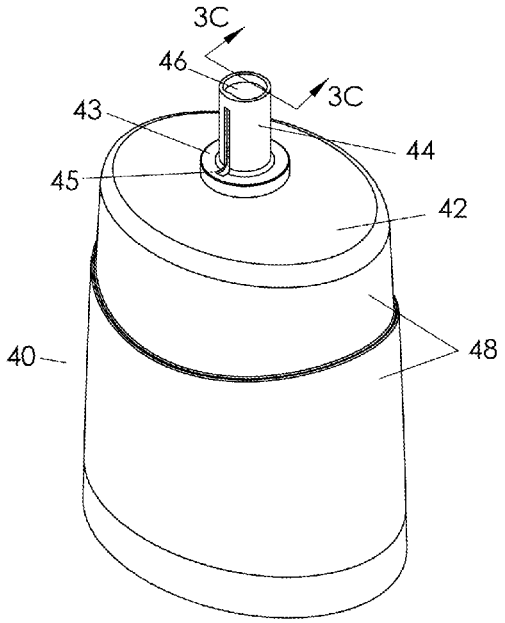
FIG. 3-A
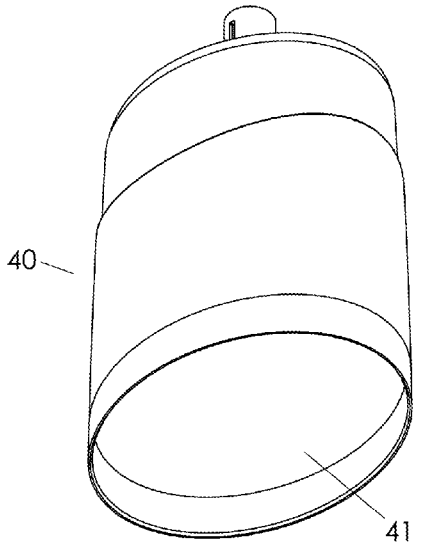
FIG. 3-B
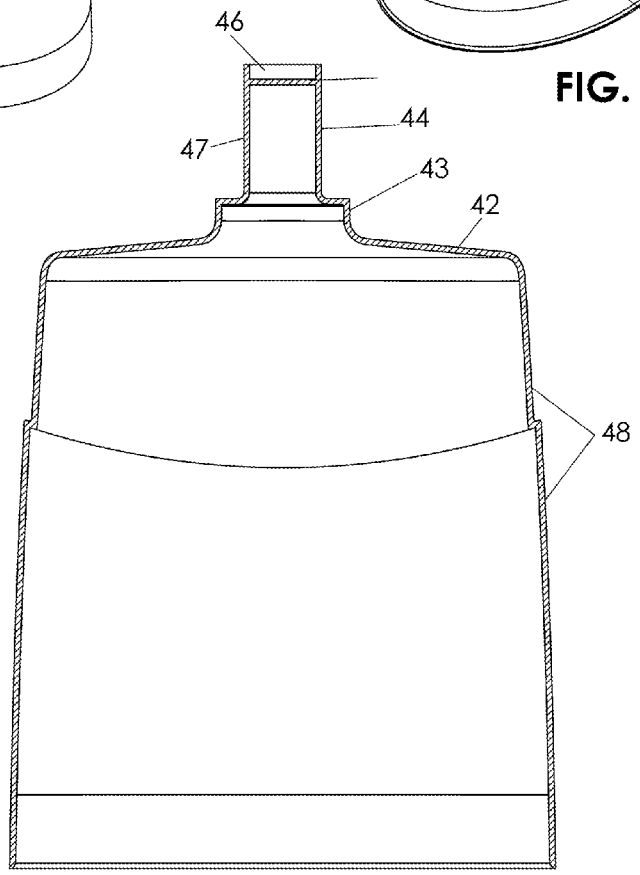
FIG. 3-C

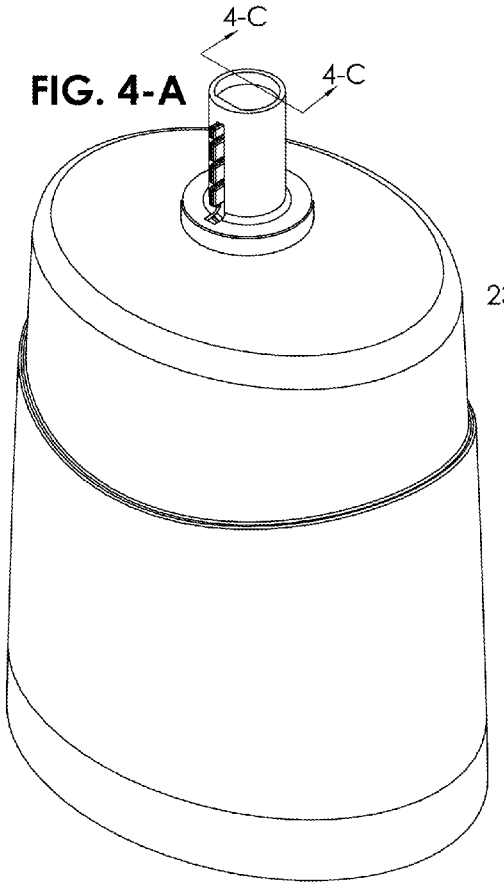
FIG. 4-A
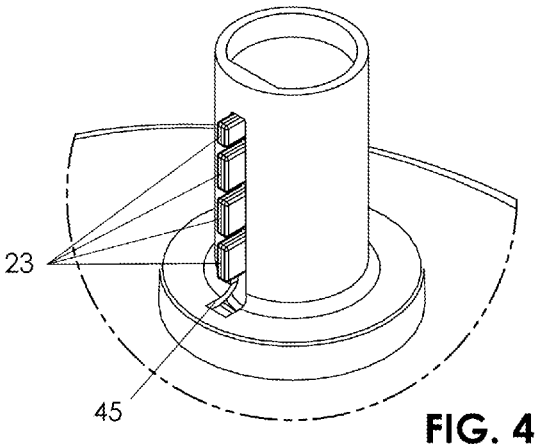
FIG. 4-B
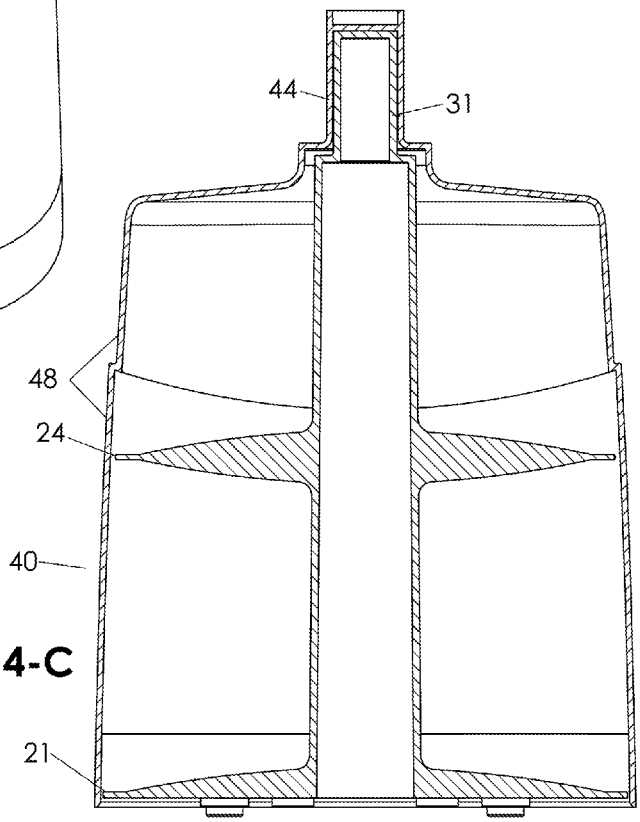
FIG. 4-C

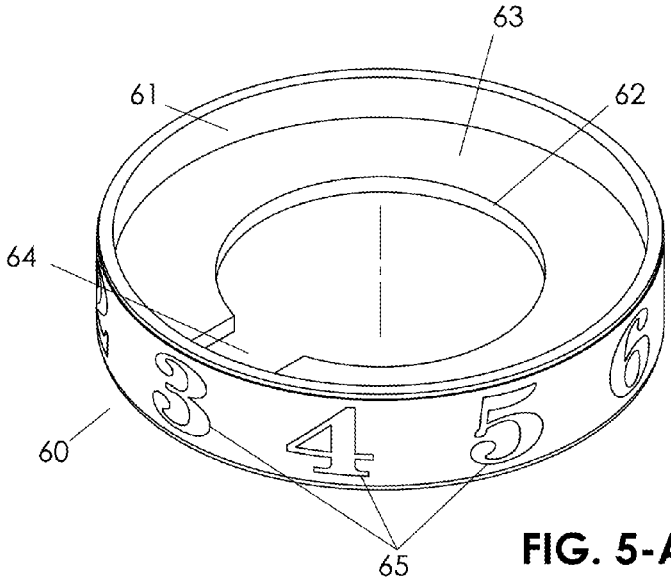
FIG. 5-A
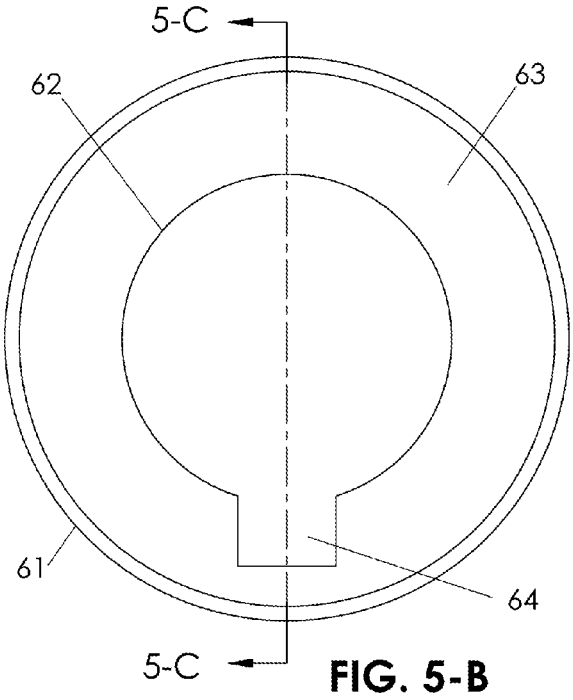
FIG. 5-B
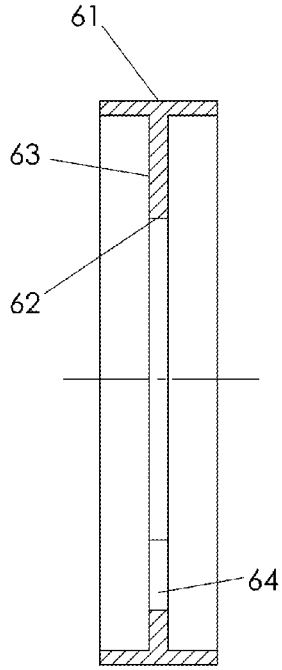
FIG. 5-C

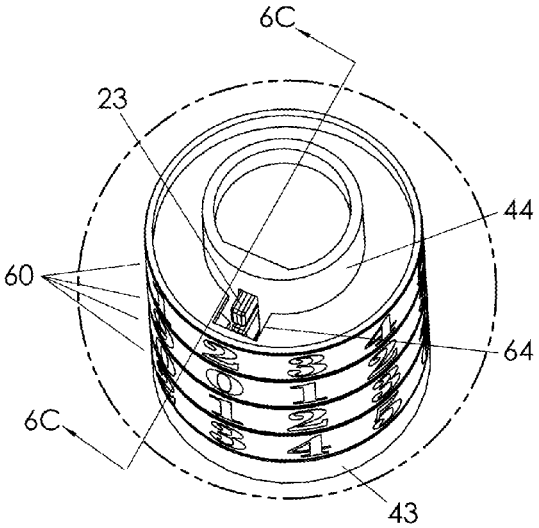
FIG. 6-A
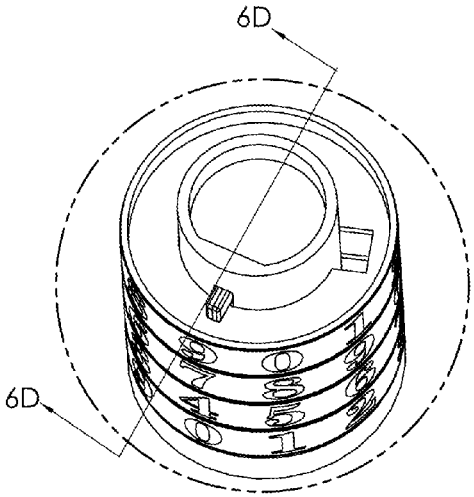
FIG. 6-B
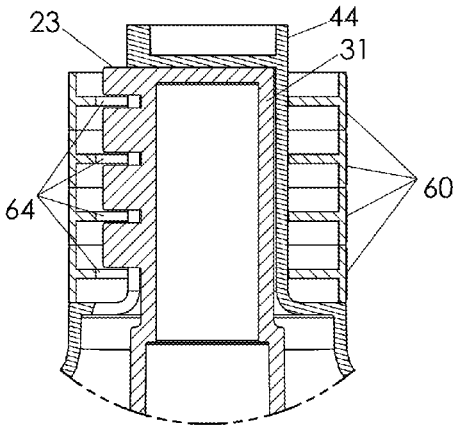
FIG. 6-C
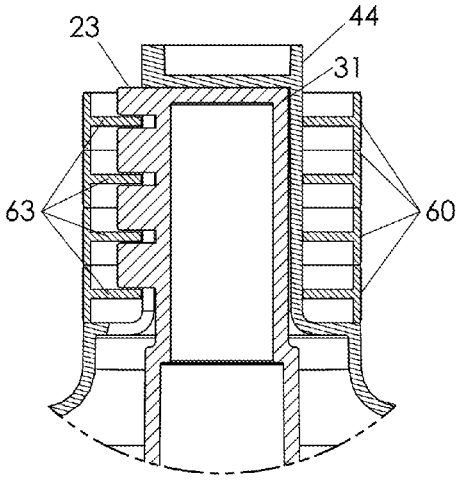
FIG. 6-D

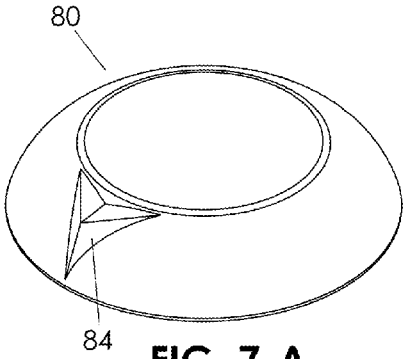
FIG. 7-A
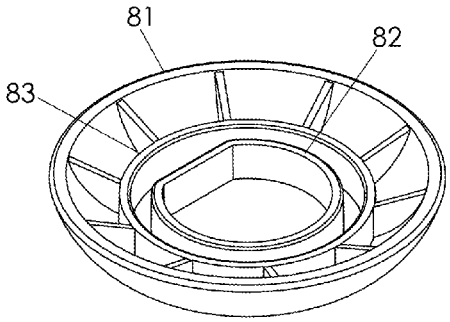
FIG. 7-B
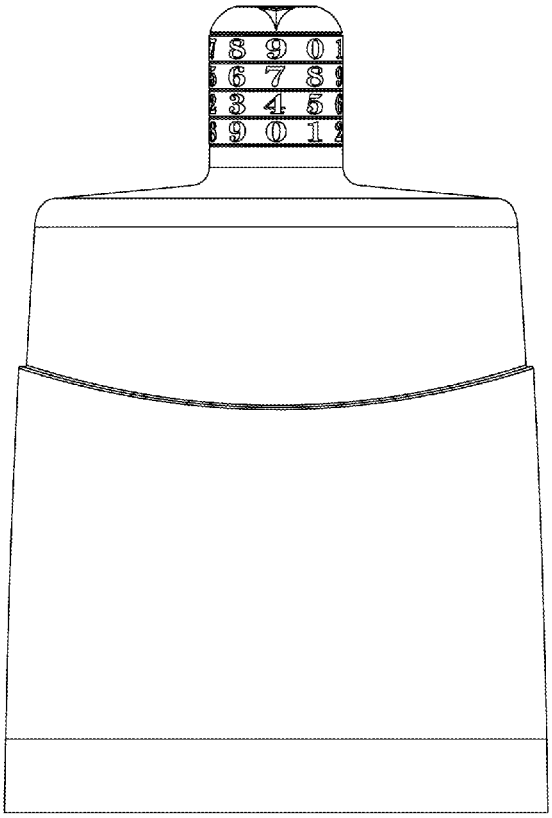
FIG. 7-C
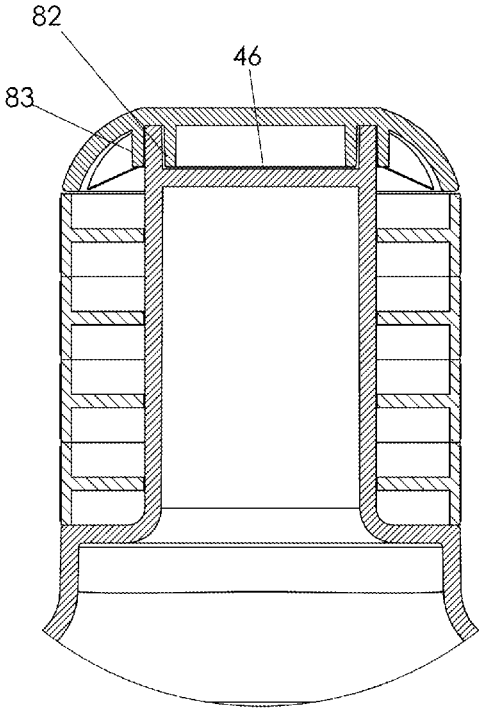
FIG. 7-D

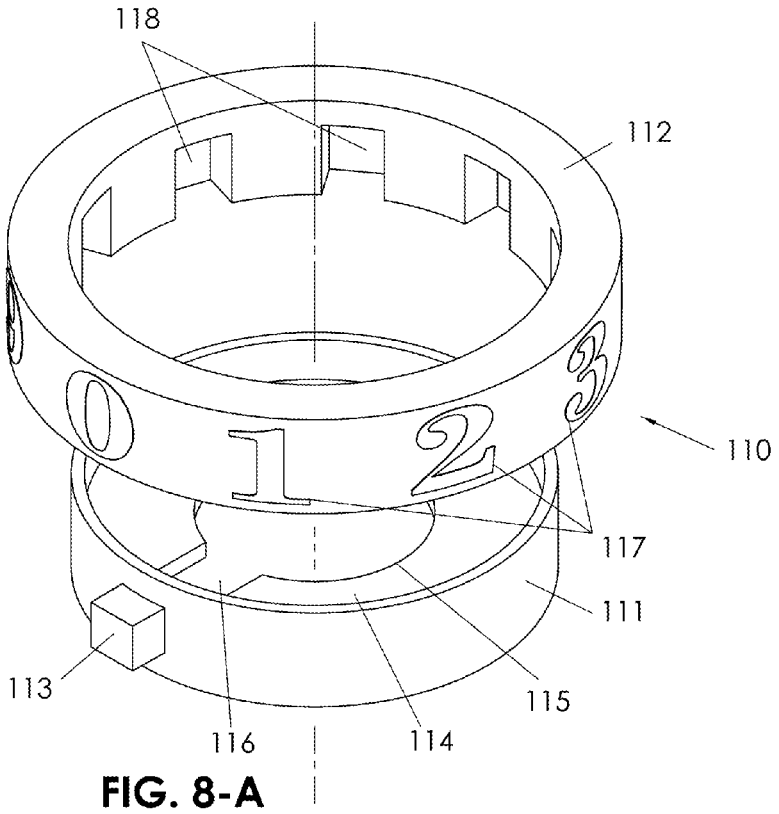
FIG. 8-A
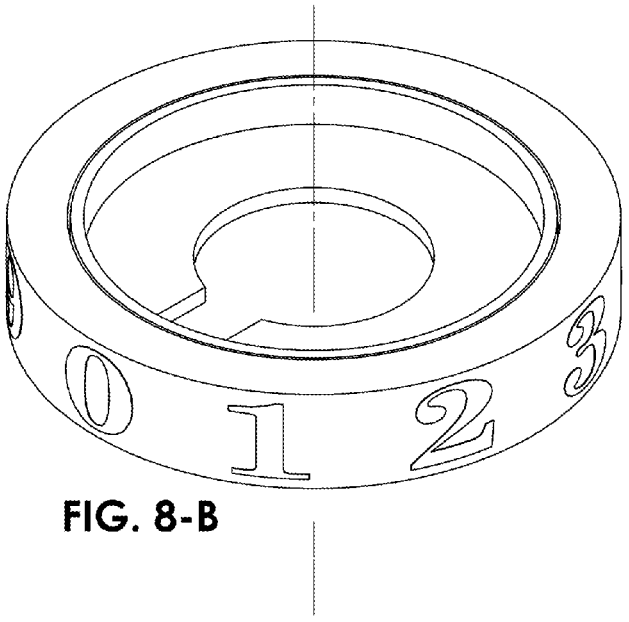
FIG. 8-B

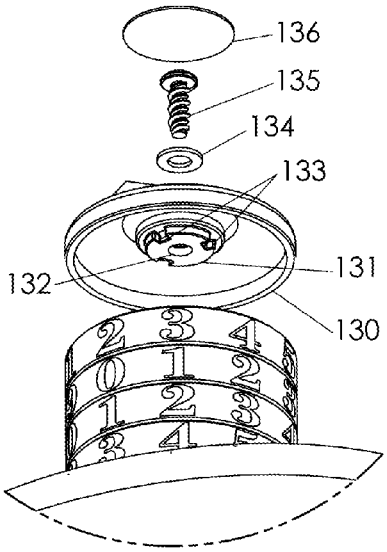
FIG. 9-A
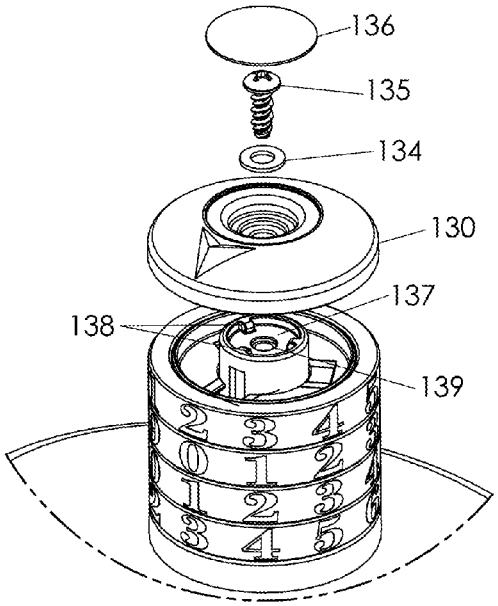
FIG. 9-B
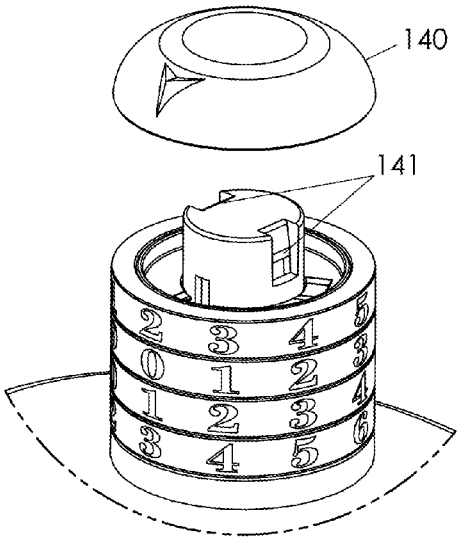
FIG. 9-C
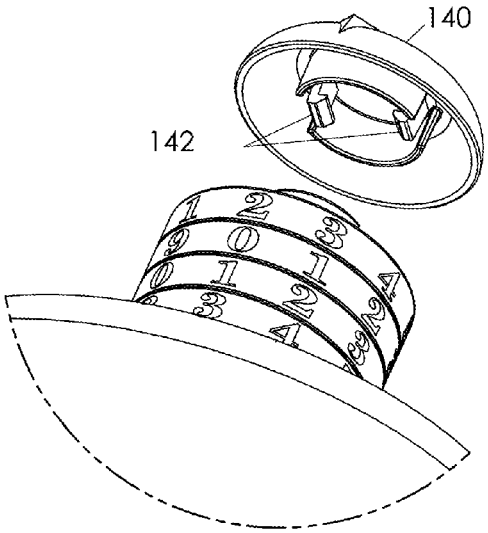
FIG. 9-D

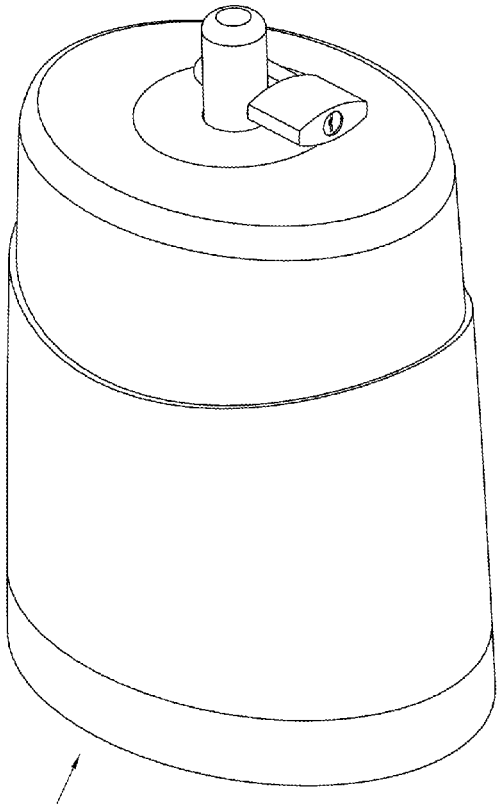
FIG. 10-A
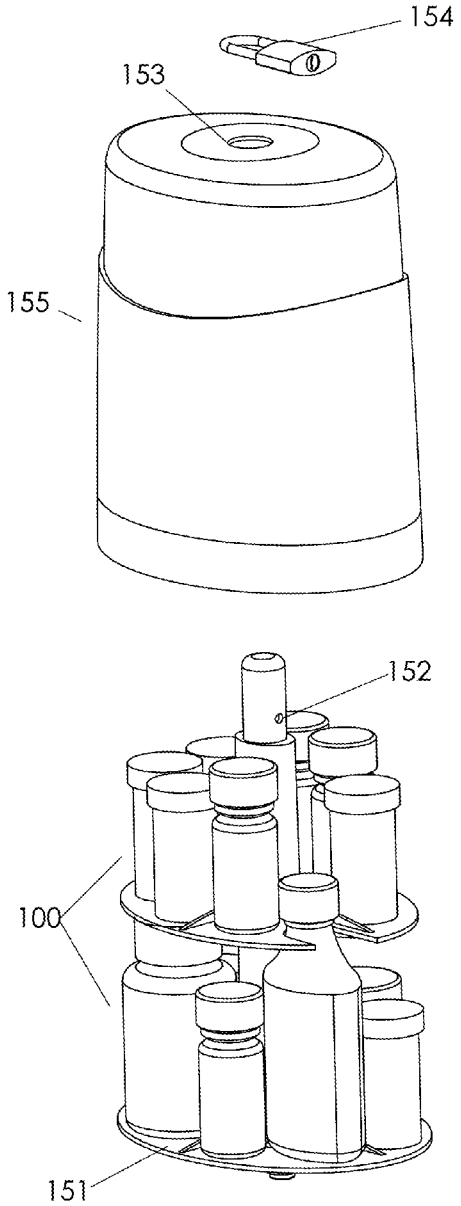
FIG. 10-B

COMBINATION LOCKING STORAGE CONTAINER

CROSS-REFERENCE TO RELATED APPLICATIONS

This application claims the benefit of PPA Ser. No. 61/758,741, filed 2013 Jan. 30 by the present inventor.

FEDERALLY SPONSORED RESEARCH

None

SEQUENCE LISTING

None

TECHNICAL FIELD

This invention relates to lockable storage containers. In particular this disclosure relates to a storage container that utilizes a combination locking cover assembly that can secure an enclosed tray and the contents held within.

BACKGROUND OF THE INVENTION

This invention relates to a lockable storage container which can be used for securing various items including but not limited to prescription drugs, pharmaceuticals, hospital and office supplies, chemicals, household cleaning products, personal electronics, cell phones, jewelry, wallets, personal items and the like. Other applications might include its use as a portable transparent locking case for the display of jewelry or other valuable items.

The most significant application for the device's use might be for better securing prescription drugs in homes, heath care facilities and doctors offices. Misuse and diversion of pharmaceutical drugs is a significant problem in today's society. Drugs can often be stolen from the prescribed person without their knowledge. They are often taken from unsecured medicine cabinets, bathroom counters, kitchen cabinets, etc. In addition, each year, sadly, medicines can unfortunately fall into the hands of toddlers and small children who can ingest them resulting in illness and sometimes death. The most significant uses for this device is to provide a simple and convenient, low cost means of security to prevent easy free access and theft of prescription drugs. Other uses include providing a safe means for storing and securing household cleaners and poisonous substances. The device can have various sizes and capacities to hold various bottle shapes and sizes for pills, liquids, ointments, etc. Likewise the device can secure items of value such as wallets, money, cell phones, jewelry, passports, documents, and other items. The container can be unattached and portable or permanently mounted inside of a cabinet or closet.

PRIOR ART

Cases with resettable combination locking hasps, such as used in briefcases or metal lock boxes, are examples of locking storage containers. Several companies currently manufacture such hinged lock boxes. U.S. patent D621152, Lebow shows a locking medicine bag. U.S. Pat. No. 6,059,135, John James et al shows a lockable safety container. U.S. Pat. No. 4,854,448, Hair shows a child proof locking container for storing medicines. Electronic, biometric finger print reading, or programmable keypad entry devices are also currently available, some of which are designed to mount into existing medicine cabinets. Many patents exist for child proof closures as well as ones that use locking tumblers to secure a cap to a bottle. Such devices are described in U.S. Pat. No. 3,445,021 Johnson et al; U.S. Pat. No. 3,407,954 Miliis; D664350 & U.S. Pat. No. 8,020,415 Corbin & Warner; D512831 Chue; U.S. Pat. No. 5,284,262 O'Nan; U.S. Pat. No. 7,350,655 Belden, U.S. Pat. No. 5,277,325 Yan. Still other pill cases designs include U.S. Pat. No. 6,000,546 & U.S. Pat. No. 8,006,845, Noble et al; US 2005/0029155 A1 Edwards. U.S. Pat. No. 8,201,705, Williamson shows a cover that uses a combination lock to secure a dish. Other combination locking containers also include U.S. Pat. No. 7,252,204 Small, the inventor of this patent application. A transparent portable security case is described in U.S. Pat. No. 7,918,362, Schmitt.

OBJECTS AND ADVANTAGES

It is the object of the present invention to provide a combination locking storage container that has the following advantages which are:

(a) to act as a deterrent or barrier to unauthorized access of items held within;
(b) to function as a locking case for jewelry and other valuable items;
(c) to provide an economic solution for securing medications within the households;
(d) to provide a simple, locking container requiring neither batteries or nor electronics;
(e) to provide an easy to manufacture device with minimal number of working parts;
(f) to have design versions with enough storage capacity for holding larger quantities of packaged prescription drugs of various shapes and sizes or household cleaners and hazardous materials.

Still further objects and advantages will become apparent from a consideration of the ensuing description and drawings.

SUMMARY

This invention pertains to a combination locking container consisting of a tray and a combination locking cover assembly which can be placed over the tray to secure it.

The tray has a flat horizontal base wall that can be of any shape perimeter or footprint. The size or area of the base wall can accommodate placement of several personal items. Extending vertically upward from the center of the base wall is a column that can be of any cross-section shape. Extending above the column is a cylindrical post portion. Note that this post can be structurally supported above the tray by means other than a central column. For instance, two opposing bars formed on the periphery can extend and create an arch above the tray. The post can be integrally formed into the arch and extend above it. Projecting outwardly from the post's outside diameter is a linear array of tabs. The tab array is oriented in downward vertical direction from the top of the post. The tabs and post together represent a "key post" feature. For greater capacity and storage space, the tray might also include one or more additional shelves spaced above the base. The additional shelf may either be integrally formed or be a separate part that can have height adjustment with suitable means for attachment. If an additional shelf is integrally formed, it may have one or more areas cutaway in the wall to provide clearance for taller bottles or objects placed beneath. The base flange can include screw holes or other means for attaching the tray to a cabinet shelf should permanent mounting of the locking container be desired. Rubber pads may be included on the bottom surface to prevent scratching on surfaces where the device is placed.

The combination locking cover assembly consists of a cover, set of locking tumblers, and a retaining cap.

The cover is generally a hollow thin walled part of uniform wall thickness, having interior and exterior surfaces, a vertically oriented side wall, an upper wall, and fully open at the bottom. The side walls can be tapered or be straight. The general form factor of the cover can be cylindrical, elliptical, rectangular, etc. Illustrations of this application show the horizontal cross-sectional form factor as being elliptical. When assembled over the tray, the cover's opening at the bottom is sized appropriately to surround and provide a close fit with the tray's base wall. The cover side wall extends just below the tray thus fully sheathing the tray when assembled. Likewise, in the assembled state, clearance exists between any additional tray shelving and the interior surface of the cover side wall. A short protrusion extends vertically above the upper wall of the cover and creates a "tumbler seat" which is used to support the stack of tumblers. Projecting upwardly from the tumbler seat is a cylindrical shaft portion with a closed top end. A vertical key slot cuts through the tumbler seat and partially through shaft side wall. The cover's key slot provides clearance with the tabs of the key post and permits assembly and disassembly. A D-shaped profile counterbore is recessed into the top end of the shaft. The counterbore serves as a female mating feature used to assemble the retaining cap. The flat of the D-shape acts as an angular alignment feature in mating between the cap and cover. The inside diameter of the cover shaft has a close concentric fit and allows free insertion and extraction of the key post and tabs when cover assembly is either installed or removed. With cover assembly installed over the tray, the key post tabs project outwardly past the shaft's outside diameter. The cover is vertically supported by the top of the key post.

Each tumbler consists of a short cylindrical wall with its central axis oriented vertically. From the tumblers inner surface, and centered to the tumbler height, a horizontal planar wall or locking rib projects inwardly, terminating and leaving a hole at the center. A notch, or keyway opening, the width of which is equal to that of the cover's key slot, cuts through the locking rib wall. A set of indicia are equally spaced in a radial array on the outside diameter surface of tumbler. One of the indicia may be assigned as part of an unlocking code and is angular alignment and positioned directly in front of the keyway opening. The tumbler's inside diameter has close diametral fit with the cover shaft. A set of tumblers may be inserted onto the cover shaft, stacked above and supported by the tumbler seat. The tumblers may freely rotate on the cover shaft. The wall thickness of the locking rib is just slightly less than the gap height or spacing between the tabs of the key post. Discreet elevation of the stacked tumblers allows each locking rib to be centered with and have direct correspondence to a gap present between the tabs of the key post. An open channel for full insertion or extraction of key post is created when all tumbler keyways are in alignment with the cover's key slot. This open condition allows the cover assembly to be installed or removed from the tray. Thus when fully assembled, the tumblers may rotate freely on the cover shaft with each locking rib engaging a gap between the tabs of the key post.

The retaining cap is used both to axially hold down and secure the stack of tumblers as well as to provide a location for aligning the tumbler indicia and unlocking code. The cap is a part with uniform wall thickness with top and bottom surfaces and a peripheral edge. The cap may have various shapes, have curvature, or may be simply flat or disc shaped. The cap's outer diameter fully covers the tumblers and may extend further. An alignment indicator or "marker" is visible on the top surface of the cap. Projecting downwardly from the bottom surface of the cap is a D-shaped profile protrusion or male mating feature. The male mating feature fits into and provides alignment with the D-shaped profile counterbore or female mating feature on top of the cover shaft. Cover and cap may be press fit together via these mating features with a suitable high strength adhesive or solvent thus creating a strong bonded joint between the two and permanently capturing the tumblers to the cover. Note that the cap secures the tumblers to the cover and allows them to freely rotate with minimal axial play. Other methods exist and are possible for securing the cap to the cover such as ultrasonic welding of plastics, mechanical fasteners, screws, retaining rings, etc as well as barbed plastic snap leg features, etc. With the cap aligned and bonded to the cover, the marker feature is positioned directly over the cover's key slot. Tumbler indicia may be rotated with the correct unlocking code displayed beneath the marker. In this unlocked condition the keyway openings of all tumblers are in alignment with the key slot of the cover and cover assembly may be installed or removed from the tray. With the cover assembly placed over the tray, rotation of any one tumbler from the unlocked condition causes the locking rib to intersect or engage between the gaps of the key and defines a locked condition. In this locked condition, the cover can not be removed from the tray and any contents held within are secured.

BRIEF DESCRIPTION OF THE DRAWINGS

FIG. 1-A shows the preferred embodiment of the combination locking container.

FIG. 1-B shows an exploded view of the container with prescription medicines placed on the tray.

FIG. 2-A shows an oblique view looking down at the tray.

FIG. 2-B shows an oblique view looking beneath the tray.

FIG. 2-C is a cross-sectional view of the tray, post and key features.

FIG. 3-A shows an oblique view looking down at the cover.

FIG. 3-B shows an oblique view looking beneath the cover.

FIG. 3-C is a cross-sectional view showing the cover side walls, tumbler seat, and shaft.

FIG. 4-A shows an oblique view of the tray and cover assembled.

FIG. 4-B shows a detailed view of the tray key feature penetrating from the cover shaft.

FIG. 4-C shows a cross-sectional view of the tray assembled to the cover.

FIG. 5-A shows an oblique view of the locking tumbler

FIG. 5-B shows a top view of the locking tumbler.

FIG. 5-C shows a cross-sectional view of the locking tumbler.

FIG. 6-A shows an oblique view of the locking tumblers stacked on to the cover with tray post inserted and tumblers aligned to the open position.

FIG. 6-B shows an oblique view of the locking tumblers stacked on to the cover with tray post inserted and tumblers aligned to a locked position.

FIG. 6-C shows a cross-sectional view of the locking tumblers stacked on to the cover with tray post inserted and tumblers aligned to the open position.

FIG. 6-D shows a cross-sectional view of the locking tumblers stacked on to the cover with tray post inserted and tumblers aligned to a locked position.

FIGS. 7-A and 7-B show oblique views of the retaining cap.

FIG. 7-C shows a front view of the cover assembly.

FIG. 7-D shows a sectional view of the retaining cap and its attachment to the cover shaft.

FIG. 8-A shows an exploded view of inner and outer two piece tumbler set embodiment.

FIG. 8-B shows inner and outer two piece tumbler set embodiment assembled and nested together.

FIGS. 9-A and 9-B show oblique exploded view of hardware as means of attaching retaining cap.

FIGS. 9-C and 9-D show oblique exploded view of snap leg features as means of attaching retaining cap.

FIGS. 10-A and 10-B show an embodiment using a padlock to secure the cover to the tray post.

DRAWINGS

Reference Numerals

Figure 11:
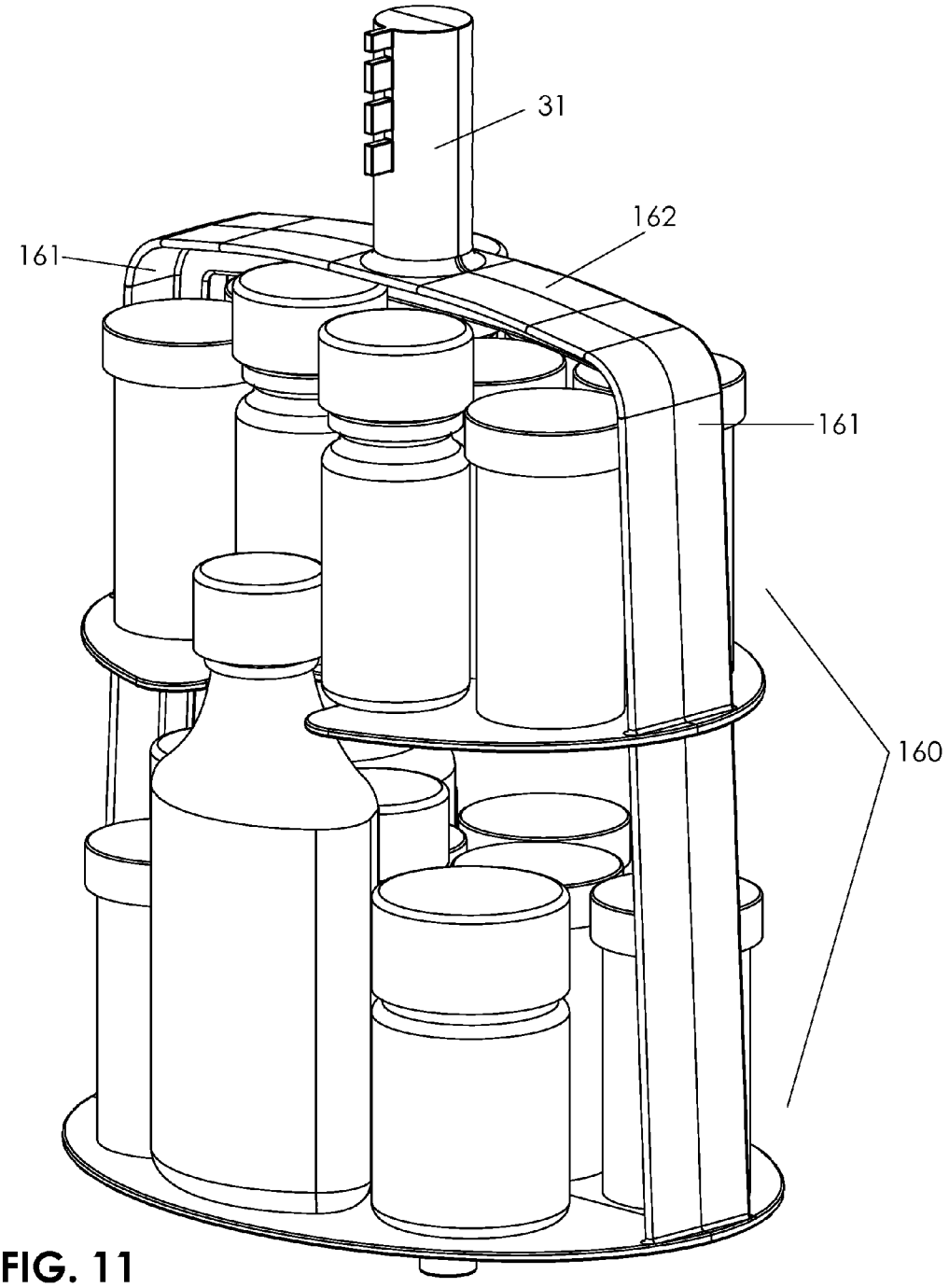
FIG. 11 shows an alternative means for supporting the post with side bars merging above the tray and creating an arch.

10 combination locking storage container assembly
20 tray
21 horizontal base wall
22 lower portion of column
23 linear array of tabs
24 shelf
25 support ribs
25A cut away area on shelf
26 upper portion of column
27 through holes and counterbores for screw mounting
28 screws
29 pockets for rubber pads
30 rubber pads
31 key post
40 cover
41 open bottom end of cover
42 upper wall of cover
43 tumbler seat
44 cylindrical shaft of cover
45 key slot of cover
46 female assembly feature
47 outside diameter of shaft
48 cover side wall
49 cover assembly
61 thin walled short cylinder
62 inside diameter of tumbler
63 horizontal annular locking rib
64 keyway opening
65 set of indicia
80 retaining cap
81 peripheral edge of retaining cap
82 male assembly feature of retaining cap
83 supporting cylindrical wall of retaining cap
84 marker
100 prescription drug bottles
110 two piece tumbler set
111 inner tumbler
112 outer tumbler
113 rectangular tooth
114 annular locking rib, inner tumbler
115 inside diameter of inner tumbler
116 keyway of inner tumbler
117 indicia of outer tumbler
118 recesses on outer tumbler
130 retaining cap, screw assembly version
131 male assembly feature, retaining cap, screw assembly version
132 clearance hole for screw, screw assembly version
133 alignment slots, screw assembly version
134 washer, screw assembly version
135 screw
136 tamper-proof adhesive label, screw assembly version
137 female assembly feature, cover shaft, screw assembly version
138 alignment ribs, screw assembly version
139 screw hole, screw assembly version
140 retaining cap, snap leg assembly version
141 side relief and slot feature, snap leg assembly version
142 snap legs of retaining cap, snap leg assembly version
150 locking container assembly, padlock version
151 tray for padlock assembly
152 post cross hole
153 cover opening
154 padlock
160 tray with side bars
161 side bars
162 horizontal portion of arch

DETAILED DESCRIPTION

FIGS. 1-A Through 7-D, Preferred Embodiment

A preferred embodiment of the container of the present invention is illustrated in FIGS. 1-A through 7-D. The present invention provides a combination locking storage container assembly 10 shown generally in FIG. 1-A. FIG. 1-B shows an exploded view of the device consisting of a tray 20, and a combination locking cover assembly 49. The cover assembly comprises a cover 40, a set of locking tumblers 60, and a retaining cap 80. The container can hold any number of items including, but not limited to, prescription drug bottles 100.

FIG. 2-A shows an oblique view of the tray from above. FIG. 2-B shows an oblique view of the tray from beneath. FIG. 2-C shows a cross-sectional view of the tray. The tray may be manufactured as one continuous molded part or alternatively produced in sections and suitably joined together. The tray consists of at least one horizontal base wall 21. The base wall may have any peripheral edge profile or "footprint," but illustrated here, it is shown generally as elliptical in shape. A column projects vertically from the center of the base wall and is define by a lower column portion 22 and an upper column portion 26. A cylindrical key post portion 31 extends further above the upper column portion. Although the post may produced fully solid, it is represented here as generally being hollow with a uniform wall thickness. The cross-section of the column could be cylindrical, square, hex, cross ribs, etc., however it is illustrated here as having an elliptical horizontal cross-section. Projecting outwardly from the key post's outside diameter is a linear array of tabs 23. The tab array is oriented in downward vertical direction from the top of the post. The tabs and post together represent a key post feature. The tray may include one or more additional shelves 24 for additional storage of items. The additional shelf may be a separate part with suitable means for attaching it at variable heights above the base wall or it could be integrally formed as a feature of the tray. As shown in the illustration, an integrally formed shelf is cantilevered from the central column and located at a distance above the base wall. Gussets or support ribs 25 may be included to provide better rigidity and support to the base and shelves. One or more cut away areas on the shelves 25A may be provided to allow clearance for taller times placed beneath the shelf. Through hole and counterbore mounting features 27 in the base wall allow the tray to be secured to a cabinet or stationary table top with screws 28. Other means for mechanically securing the tray could include mounting brackets, clips etc. For portable use, blind pockets 29, projecting beneath the base wall, can accept rubber pads 30 for better traction and to resist scratching or scuffing of surfaces where the unit is placed.

FIG. 3-A shows an oblique view of the cover 40 from above. FIG. 3-B shows an oblique view of the cover from beneath. FIG. 3-C shows a cross-sectional view of the cover. The cover is generally a hollow thin walled part of uniform wall thickness, having interior and exterior surfaces, a vertically oriented side wall 48, an upper wall 42, and a fully open bottom end 41. The side wall can be tapered or be straight. The general form factor of the cover can be cylindrical, elliptical, rectangular, etc. When assembled over the tray, the cover is sized appropriately to have a close circumferential fit with and sheath the tray's base wall and shelves. A short cylindrical protrusion, centered to the cover's vertical axis, extends above the upper wall of the cover. A flat planar wall formed at the top of this protrusion creates a tumbler seat 43. The diameter of the tumbler seat is approximately equal to or greater than the outside diameter of the tumblers. Further extending vertically from the center of tumbler seat is a cylindrical shaft 44 with outside diameter 47. Top end of the shaft is closed. A vertical key slot 45 cuts through tumbler seat and partially though shaft. Recessed and formed into the top closed end of the shaft is a D-shaped profile counterbore, or female assembly feature 46, which used to align and assemble the retaining cap.

FIG. 4-A shows an oblique view of the cover assembled over the tray. FIG. 4-B shows close up details of the key post tabs 23 projecting through the cover's key slot 45. Cross-sectional view FIG. 4-C shows the outside diameter of the tray's key post 31 concentrically nested to and fitting within the cover's shaft portion 44. The cover is vertically supported by the top of the key post. Also shown is the close proximity of the cover side wall 48 in relation to the tray's base wall 21 and shelves 24. The cover creates a sheath around the tray and extends vertically just below the tray's base wall.

FIGS. 5-A through 5-C show respectively an isometric, top, and section view of a locking tumbler 60. The tumbler has a thin walled short cylinder 61 with its central axis in a vertical orientation and having inner and outer surfaces and planar surfaces at top and bottom respective ends. From the tumbler's inner surface, a horizontal annular locking rib 63, positioned at mid-height with respect to the cylinder, extends partially inwardly creating hole at the center. The hole thus defines the inside diameter of the tumbler 62. The tumbler's inside diameter is sized for a close concentric fit with outside diameter of the cover shaft. The thickness of the locking rib is less than the gap or height between the tabs on the tray post. A notch intersects the locking rib wall and creates a keyway opening 64. The keyway profile is sized for clearance with the tabs on the tray post. A set of indicia 65 are spaced equally in a radial arrangement on the outside diameter surface of the tumbler. These indicia may be applied to the tumbler in any number of ways including, but not limited to, silk screening, painting, hot stamping, mold textures, embossing or debossing, application of labels, etc. Indicia applied via adhesive backed labels allows for personal code selection and recombination as well. A select, predetermined indicia character, representing one character of an unlocking code, has alignment with, and is positioned directly in front of the keyway. The present embodiment shows uses the numerals 0 through 9 as the indicia. The type of indicia used could vary. Symbols, letters, colors, Braille, etc. are examples of other types of indicia that could potentially be used. As shown in FIG. 5A, the numeral "3" is centered to and directly in front of the tumbler keyway. This number "3" would be associated as being one digit of an unlocking code. Thus a set a set of tumblers can be inserted on to the cover shaft, stacked above and supported by the cover's tumbler seat, and rotate freely about the shaft. The tumblers can be rotated such that their keyways are in vertical alignment with and match the keyway slot of the cover, thus one continuous vertical keyway can be created though the cover and assembled tumblers. The inside diameter of the cover shaft is sized for a close concentric fit with the outside diameter of the tray's key post. With assembled tumbler keyways and cover key slot in alignment, there is clearance for both free insertion and extraction of the key post though the center of the cover assembly.

FIG. 6-A shows locking tumblers 60 assembled onto the cover shaft 44 and resting on the cover's tumbler seat 43, tumbler keyways 64 aligned with the tabs 23 and in an unlocked condition with unlocking code 2-0-1-3 shown. FIG. 6-B shows the tumblers rotated to a locked condition. FIG. 6-C shows a cross-sectional view of the tumblers assembled and positioned in the unlocked condition with tumbler keyway openings 64 in vertical alignment with the tabs 23. FIG. 6-D shows a cross-sectional view of the tumblers rotated to a locked condition with where the tumbler locking ribs 63 intersect gaps between tabs thus interlocking the cover to the tray. Note that the height of each positioned tumbler places the locking ribs at the same elevation and centered to the gaps between tabs on the key post. Sufficient clearances exist for the locking rib to travel freely between the tabs of the key. Likewise there is sufficient clearance between the inside diameter of the tumbler and the cover shaft's outside diameter for free rotation.

FIGS. 7-A and 7-B shows and top and bottom oblique views of the retaining cap 80. FIG. 7-C shows the locking cover assembly. FIG. 7-D shows a cross-sectional detail view of the cap attachment. The purpose of the retaining cap is to cover, capture and axially retain the stacked locking tumblers to the cover and prevent their removal. The cap is a generally a thin walled part with top and bottom surfaces and peripheral edge wall 81. Its peripheral edge is circular—the diameter of which is approximately equal to or greater than the outside diameter of the tumbler. Projecting downwardly from the bottom surface of the cap is a male assembly feature 82 that has a D-shaped horizontal cross-sectional profile. This protruding male feature is sized to nest into and align with the female assembly counterbore feature of the cover shaft 46. A supporting cylindrical wall 83 fits over the cover shaft's outside diameter and provides additional strength to the attachment. Cover and cap may be ultrasonically welded or bonded together via these mating features with a suitable high strength adhesive thus creating a bonded joint between the two and permanently capturing the tumblers to the cover. With the retaining cap assembled there is close but sufficient space between the retaining cap and tumbler seat for the locking tumblers to rotate freely without excessive axial play. Note that there are many other means for attaching the cap to the cover post besides ultrasonic welding or adhesive and solvent bonding. These will be discussed in a following alternate embodiment section. Other methods might include, but are not be limited to, use of mechanical hardware such as screws, fasteners or retaining rings, locking snap leg features, heat staking etc. Shown in FIG. 7-A is an alignment indicator or marker feature 84 located on the top surface of the cap. With the tumblers assembled, the cap can be joined to the cover, placing the marker feature in direct vertical alignment with the cover's key slot. Tumbler indicia may be rotated with the correct unlocking code displayed beneath the marker thus creating an open condition for the cover assembly. The cover assembly may then be fully placed over the tray, where the tray's key post can be fully inserted into the interior of the cover assembly through the open key slot and tumbler keyways. As previously mentioned, with the cover assembled to the tray, the locking rib on each tumbler is in vertical alignment with a corresponding gap on the tray's key post. Rotating the tumblers away the unlocked condition causes the locking ribs to engage between the gaps and intersect the key tabs. Thus the tumblers create interlocking between the cover and tray post key feature and define a locked condition for the container. In this locked condition, the cover can not be removed from the tray and any contents held within are thus secured.

DETAILED DESCRIPTION

Two Piece Tumbler Set, Alternate Embodiment

Other embodiments of the tumblers might allow the unlocking code to be selectively chosen rather than pre-assigned. FIGS. 8-A and 8-B show a two piece tumbler set 110 consisting of an inner tumbler 111 and an outer tumbler 112. Both tumblers have equal height and are cylindrical in shape. The inner tumbler has the ability to concentrically nest within the outer tumbler. The inner tumbler has a single rectangular tooth 113 protruding radially from its outside diameter. An annular locking rib 114 protrudes radially inward from the inside surface. The locking rib is centered in height, with respect to the inner tumbler. The central opening created by the locking rib represents the inside diameter 115. A notch cut through the locking rib creates a keyway 116. The keyway is annularly positioned directly behind the tooth feature. The keyway profile has clearance with the tabs on the tray post.

The outer tumbler has indicia 117 equally spaced in a radial arrangement on the outside diameter surface. Directly behind each of the indicia, formed on inside surface, are recesses 118 that are suitably sized to mate with and accept the tooth of the inner tumbler. With the tooth feature on the inner tumbler having the ability to fit and index behind any of the indicia on the outer tumbler, the two piece tumbler set permits any one of indicia to be assigned as part of the unlocking code.

DETAILED DESCRIPTION

Alternative Means for Attachment of Retaining Cap

Of the various means for attaching the retaining cap to the cover shaft FIGS. 9-A through 9-D show details of two these methods. FIGS. 9-A and 9-B show attachment of a retaining cap 130 using a washer 134 and a screw 135 which assembles through a clearance hole 132 in the male protruding assembly feature 131 of the cap. Alignment slots 133 or relief cuts accept male alignment ribs 138 in the counterbore or female assembly feature 137 of the cover shaft. The counterbore has a hole in the center 139 into which the screw can fasten. Once the retaining cap is assembled, a tamper proof seal 136, backed with high bond adhesive, may be place on top of the cap to cover the screw. Rather than slotted or Phillips head, the screw used may also be a of security type to prevent removal.

FIGS. 9-C and 9-D show a retaining cap 140 with snap legs features 142 projecting from underside of the part. The snap legs assemble into side relief and slot features 141 of the cover post, thus providing means to lock the cap to the cover shaft.

DETAILED DESCRIPTION

Padlock Embodiment

FIGS. 10-A and 10-B show a locking container assembly 150 consisting of a tray 151, a cover 155, and a padlock 154. The tray has a vertical center post and cross hole 152 perpendicularly intersecting at the top end of the post. The cover has an opening 153 in its upper wall that permits the tray post to penetrate through. With the cover assembled to the tray, the padlock may be installed though the post cross hole, thus locking the cover to the tray and securing medications 100 or any contents held within.

DETAILED DESCRIPTION

Alternate Tray and Method for Supporting of Key Post Feature

FIG. 11 shows an alternate tray 160 with two side bars 161. As previously mentioned the key post may be structurally support by means other than a central column. The side bars are integral features of the tray positioned on opposing sides. The bars merge centrally and horizontally together above the upper shelf creating an arch 162. The key post is integrally molded onto and supported by the arch. The key post cylindrical axis is aligned with the central vertical axis of the tray.

CONCLUSION, RAMIFICATIONS, AND SCOPE

The previous descriptions and drawings illustrate various embodiments for the device. Each variation has its own merits and advantages. The drawings and descriptions above do not imply or suggest any specific dimensions, wall thickness, or materials. Likewise exact values for fits, allowances, tolerances, etc. are not specified. The device could be manufactured in a larger size to secure items such as household cleaners, chemicals, among others. Accordingly, the reader will see that the combination locking storage container of this invention can secure the contents of any number items held within. With knowledge of correct unlocking code, the end user can easily align the combination with the tumblers, lift off the cover, and have quick and easy access to medications or other items held within. The device provides a level of security privacy to prevent others from gaining unauthorized access. The device can have several embodiments and sizes that are suitable for different applications, storage capacities, etc. Materials used for the components could vary and consist of metals, plastics, composites, or any combination of thereof. Means for manufacturing the parts might include, but are not limited to, deep drawn sheet metal, metal die casting, injection molding, vacuum formed plastic, etc. The preferred embodiment shown focuses on thin walled injection molded plastics, however components like the cover could easily be deep drawn die formed sheet metal. Likewise, the tray and tumblers could easily be manufactured from die cast zinc or aluminum should an application require greater strength and security. The key post may be structurally supported above the tray in any number of ways including a central column or side bars which create an arch. The invention can be configured for minimal use of parts with single piece tumblers—for use with a preset combination code or be configured to use a two piece tumbler sets that would permit personal assignment of the unlocking code. Various means for applying the indicia are available. Use of indicia via application of adhesive backed labels applied to the outside diameter of single piece tumblers also allows for personal code selection and resetting as well. Although the description and drawings show use of four tumblers, the design could be altered for use with any number of tumblers—3, 5, etc. The form factor of the container may be altered to various shapes. In brief, the device consists of a tray, a cover, a set of locking tumblers, and a tumbler retaining cap. Thus the scope of the invention should be determined by the appended claims and their legal equivalents, rather than the examples given.

What is claimed is:

1. A combination locking storage container comprising:

(a) a tray;

(b) a cover;

(c) a plurality of locking tumblers; and (d) a retaining cap;

said tray having a planar base wall of nominal thickness and with outer perimeter and suitable for placement of items thereon, said tray having structural means for supporting a cylindrical post at an uppermost position, post being vertically oriented and located on central vertical axis and above said tray, the post having a linear array of tabs projecting from its outside diameter surface and extending vertically downward from top end of the post, the tabs having discreet spacing or gaps between each other, where said cylindrical post and tabs together define a key post;

said cover being generally hollow and having uniform wall thickness, having a vertically oriented side wall, an upper wall, and fully open at the bottom, open bottom end suitably sized for a close circumferential fit around base wall of said tray, said upper wall further having a flat horizontal surface formed and defining a tumbler seat, extending vertically from said tumbler seat is a cylindrical shaft portion, the shaft being closed at its top end, said cover having a vertical longitudinal cut penetrating through said tumbler seat and partially through wall of the shaft creating a key slot, width of said key slot being sized for clearance with tabs of said key post, where inside diameter of the shaft and key slot are sized to permit insertion and extraction of key post, the top end of cover shaft further having means for attachment and alignment of said retaining cap, whereby said cover may be fully assembled over said tray, where said key post may nest inside of the cover shaft and provide vertical support to said cover, where the key post tabs project through key slot and beyond the outside diameter of the cover shaft, and where assembled cover fully sheaths said tray;

said locking tumblers being annularly shaped and having a short cylindrical outer wall, axis of which is vertically oriented, tumbler further having a planar horizontal wall or annular locking rib centered with respect to the tumbler's height and extending inwardly from inside surface of the cylindrical wall, the locking rib terminating at a circular opening at the center of the tumbler thus defining an inside diameter of the tumbler, the locking rib having a notch or portion of its wall section removed thereby creating a keyway opening, where profile of the keyway is sized for clearance with the tabs of said key post, where the inside tumbler diameter is just greater than outside diameter of cover shaft, where the thickness of the locking rib wall is just less than gap or spacing between tabs of said key post, said locking tumbler having means for acceptance of programmable indicia onto the outer diameter surface, wherein assigned indicia may be aligned with and positioned in front of the keyway, where assigned indicia represents characters of an unlocking combination code used with the device, whereby with unlocking code selected and indicia assigned to all tumblers, the set of tumblers may be inserted on to the cover shaft and stacked above said tumbler seat, wherein resulting elevation of stacked tumblers places each locking rib in direct vertical alignment and centered with respect to corresponding gap between tabs in said key post, said retaining cap having uniform wall thickness with a circular perimeter, the diameter of the peripheral edge being equal to or greater than the outside diameter of the tumblers, the cap having features providing means for alignment with and attachment to the top end of the cover shaft, whereby the attached cap captures and retains the stack of assembled tumblers, said retaining cap further having a marker visible on it top surface, whereby said marker is in direct alignment with cover's key slot, and wherein cover, set of tumblers and retaining cap assembled together comprise a combination locking cover assembly;

whereby an unlocked condition is defined as all tumblers positioned with assigned indicia and unlocking code beneath said marker on the cap, thus resulting in all tumbler keyways being in alignment with said key slot and tabs of key post, and where cover assembly may be freely inserted onto or extracted from said key post and tray, and where a locked condition is defined by rotation of one or more tumblers where locking ribs engage gaps between tabs of said key post, whereby in said locked condition, the cover can not be removed from the tray and any contents held within are secured.

2. A combination locking storage container of claim 1 wherein:

said tray may have one or more additional shelves positioned above the base wall.

3. A combination locking storage container of claim 1 wherein:

said programmable indicia are adhesive backed labels with indicia printed on top surface, where the label and printed indicia may be applied to and wrapped around the tumbler thereby allowing any indicia to be assigned as part of an unlocking code and aligned with the keyway.

4. A combination locking storage container of claim 1 wherein:

cover shaft has a D-shaped profile recessed female counterbore pocket formed on its top end and retaining cap has a matching D-shaped profile male protrusion extending from its bottom surface, where size of mating features permit a press fit between the two, and whereby adhesive may be applied to permanently bond the cap to cover shaft, and where D shaped profiles provide required alignment between cap and cover and position said marker directly above said key slot.

5. A combination locking storage container of claim 1 wherein:

said retaining cap has two snap leg features formed on its bottom surface, and cover shaft has two slotted openings on its side wall, whereby when cap is installed onto cover shaft, snap legs engage and are received and lock into slotted openings thus providing means for attachment between cap and cover, and snap legs and slotted openings provide proper orientation of marker to keyway slot.

6. A combination locking storage container of claim 1 wherein:

means for attaching cap to cover shaft is achieved by use of mechanical fasteners.

* * * * *